US007041419B2

(12) United States Patent
Tokutake et al.

(10) Patent No.: US 7,041,419 B2
(45) Date of Patent: May 9, 2006

(54) ORGANIC PHOTORECEPTOR UNIT

(75) Inventors: Shigeaki Tokutake, Takatsuki (JP); Keiichi Inagaki, Itami (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 10/226,359

(22) Filed: Aug. 23, 2002

(65) Prior Publication Data

US 2003/0087171 A1 May 8, 2003

(30) Foreign Application Priority Data

Aug. 31, 2001 (JP) ..... 2001-263456

(51) Int. Cl.
*G03G 5/047* (2006.01)

(52) U.S. Cl. ..... 430/58.2; 430/58.05; 430/59.6; 430/970

(58) Field of Classification Search ..... 430/58.05, 430/58.2, 59.6, 66, 970, 132, 133
See application file for complete search history.

(56) References Cited

U.S. PATENT DOCUMENTS 4,797,341 A * 1/1989 Tsubuko ..... 430/114
4,920,021 A 4/1990 Kimura et al.
4,962,008 A * 10/1990 Kimura et al. ..... 430/58.05
5,213,924 A * 5/1993 Sakamoto ..... 430/59.6
5,283,142 A * 2/1994 Mayama et al. ..... 430/59.5
5,610,690 A 3/1997 Yoshihara et al.
5,666,606 A 9/1997 Okano et al.
5,667,926 A 9/1997 Maruyama et al.
5,800,955 A 9/1998 Kashimura et al.
5,876,892 A 3/1999 Fujimori et al.
5,994,011 A 11/1999 Kashimura
6,136,521 A 10/2000 Hikosaka et al.
6,255,027 B1 * 7/2001 Wehelie et al. ..... 430/65
6,379,853 B1 * 4/2002 Lin et al. ..... 430/58.45
2003/0113642 A1 * 6/2003 Kami et al. ..... 430/57.2

* cited by examiner

*Primary Examiner*—Janis L. Dote
(74) *Attorney, Agent, or Firm*—Morrison & Foerster LLP

(57) ABSTRACT

The present invention relates to an organic photoreceptor unit that has a conductive base unit, a charge generating layer formed on the conductive base unit, a first charge transport layer that is formed on the charge generating layer and contains a first bonding resin and a first charge transport material, and a second charge transport layer that is formed on the first charge transport layer and contains a second bonding resin including denatured polycarbonate resin, fluorine resin particles and a second charge transport material, wherein the content of the second charge transport material relative to the second bonding resin is larger than the content of the first charge transport material relative to the first bonding resin.

30 Claims, No Drawings

ORGANIC PHOTORECEPTOR UNIT

RELATED APPLICATIONS

The present invention is based on Japanese Patent Applications No. 2001-263456, the contents of which are incorporated by reference.

BACKGROUND OF THE INVENTION

1. Field of the Invention

The present invention relates to an organic photoreceptor unit.

2. Description of the Related Art

The technology to include fluorine resin particles in the surface layer of a photoreceptor unit, such as the surface protective layer or the charge transport layer, are known in the conventional art as a technology to provide the surface of the organic photoreceptor unit with wear resistance and separability. In this technology, fluorine resin particles and bonding resin or the like are generally dissolved or dispersed in an organic solvent, and the obtained solution is applied to the surface in order to form a layer that includes fluorine resin particles.

However, in the above technology, if a relatively large amount of fluorine resin particles is used in order to obtain the desired level of wear resistance, the problem arises that the residual potential increases through use over a long period of time, and a fog occurs in the image.

SUMMARY OF THE INVENTION

An object of the present invention is to provide an organic photoreceptor unit that can be manufactured relatively inexpensively and that maintains good image quality, wear resistance and separability over a long period of time.

The present invention relates to an organic photoreceptor unit that includes a conductive base unit; a charge generating layer formed on the conductive base unit; a first charge transport layer that is formed on the charge generating layer and that contains a first bonding resin and a first charge transport material; and a second charge transport layer that is formed on the first charge transport layer and contains a second bonding resin including a denatured polycarbonate resin, fluorine resin particles and a second charge transport material, wherein the content of the second charge transport material relative to the second bonding resin is larger than the content of the first charge transport material relative to the first bonding resin.

The inventors of the present invention discovered that when denatured polycarbonate resin and fluorine resin particles are used in combination, the dispersability of the fluorine resin particles improves significantly and the above object is attained, thereby leading to the present invention.

DESCRIPTION OF THE PREFERRED EMBODIMENTS

The organic photoreceptor unit of the present invention comprises a charge generating layer and a multi-layered charge transport layer formed on a conductive support unit. 'Multi-layered' means that the charge transport layer comprises multiple layers.

The conductive support unit in the present invention may comprise a unit that indicates a conductivity of or less than volume resistance $1\times10^{10}$ Ωcm, i.e., a unit comprising a plastic or paper film or cylinder coated with a metal such as aluminum, nickel, chrome, copper, silver, gold or platinum, or a metal oxide such as tin oxide or indium oxide, using deposition or sputtering, or comprising an aluminum, aluminum alloy, nickel or stainless steel plate or tube that is formed via a technology such as D.I., I.I., extrusion or drawing and is subsequently subjected to surface processing via cutting, superfinishing and polishing.

A sub-layer may be formed prior to formation of the charge generating layer on the conductive support unit. While resin is generally used as the main ingredient of the sub-layer, given that a photosensitive layer is applied thereon using a solvent, it is preferred that the resin forming the sub-layer comprise a type of resin that is not easily dissolved by generally-used organic solvents. Such resins include water-soluble resins such as polyvinyl alcohol, casein and polyacrylic sodium, alcohol-soluble polyamide resins such as copolymeric nylon and methoxymethyl nylon, and cured resins that form a three-dimensional network structure, such as polyurethane, melamine resin, alkyd-melamine resin and epoxy resin. In order to reduce the residual potential more effectively and to prevent moire, micro-powder of a metal oxide such as titanium oxide, silica, alumina, zirconium oxide, tin oxide or indium oxide may be added to the sub-layer. The sub-layer can be formed using an appropriate solvent and an appropriate public-domain application method. In addition, a metal oxide layer formed via the solgel method, for example, using a silane coupling agent, a titanium coupling agent or a chrome coupling agent is also effective as the sub-layer. In addition, as the sub-layer, an $Al_2O_3$ layer formed via anode oxidization or a layer formed of an organic material such as polyparaxirylene (parylene) using the vacuum membrane method, or an inorganic material such as SiO, $SnO_2$, $TiO_2$, ITO or $CeO_2$ may also be appropriately used. Among these sub-layers, however, from the viewpoint of the ease of formation and manufacturing cost, it is preferred that an alcohol-soluble polyamide resin layer in which micro-powder of a metal oxide is dispersed be used. The appropriate thickness of the sub-layer is 10 μm or less.

The charge generating layer formed on the conductive support unit is a layer having a charge generating material as its main ingredient. While either an organic charge generating material or an inorganic charge generating material may be used, an organic charge generating material is preferred. For the organic charge generating material, any public-domain charge generating material may be used. Such materials include, for example, phthalocyanine dyes such as metallic phthalocyanine and non-metallic phthalocyanine, azulenium dyes, squaric methane dye, azo dyes having a carbazole structure, azo dyes having a triphenylamine structure, azo dyes having a diphenylamine structure, azo dyes having a dibenzothiophene structure, azo dyes having a fluorenone structure, azo dyes having an oxadiazole structure, azo dyes having a bisstilbene structure, azo dyes having a distyryloxadiazole structure, azo dyes having a distyrylcarbazole structure, perylene dyes, anthraquinone or polycyclic quinone dyes, quinonimine dyes, diphenylmethane and triphenylmethane dyes, benzoquinone and naphthoquinone dyes, cyanine and azomethine dyes, indigoid dyes, and bisbenzimidazole dyes. Preferably a phthalocyanine dye, and more preferably metallic phthalocyanine—titanylphthalocyanine in particular—is used. These charge generating materials can be used alone or two or more of them can be used in combination.

A bonding resin can be used for the charge generating layer where necessary, and when this is done, the charge generating layer comprises a bonding resin and any of the above organic or inorganic charge generating materials dispersed or dissolved therein. The content of the charge generating material in the charge generating layer in this case is preferably 50 to 300 parts by weight to 100 parts by weight of the bonding resin of the charge generating layer. Bonding resins that can be included in the charge generating layer include, for example, polyamide, polyurethane, epoxy resin, polyketone, polycarbonate, silicone resin, acrylic resin, polyvinyl butyral (butyral resin), polyvinyl methylal, polyvinyl ketone, polystyrene, poly-N-vinylcarbazol, and polyacrylamide. Polyvinyl butyral is preferred. These materials may be used alone, or two or more of them can be used combined.

Roughly classified, vacuum membrane methods and casting methods using solution dispersion can be employed in order to form the charge generating layer. The vacuum membrane methods include the vacuum deposition method, the glow discharge dissolution method, the ion plating method, the sputtering method, the reactive sputtering method and the CVD method, and any of these methods is capable of appropriately forming a charge generating layer using any of the organic or inorganic charge generating materials listed above. When forming a charge generating layer using a casting method, a charge generating layer solution is prepared by dispersing via a ball mill, an attritor or a sand mill any of the organic or inorganic charge generating materials listed above together with a bonding resin, where necessary, using a solvent such as tetrahydrofuran, cyclohexanone, dioxane, dichloroethane or butanone, and the prepared application solution is applied onto the conductive support unit or the sub-layer and dried thereon. The application method is not limited to a specific method, and any public-domain application method, such as immersion application, spray application, ring application, spinner application, roller application, meyer bar application, blade application or bead application may be used. The appropriate thickness for the charge generating layer formed in this way is 0.01 to 5 μm, and preferably 0.05 to 2 μm.

The charge transport layer formed on the charge generating layer in the present invention comprises multiple layers, and the outermost charge transport layer includes denatured polycarbonate resin, fluorine resin particles and a charge transport material. In the present invention, in order to reduce manufacturing costs and to further improve image quality, wear resistance and medium separability, it is preferred that the charge transport layer comprise a first charge transport layer and a second charge transport layer that are stacked in that order. In this case, the second charge transport layer, which is the outermost charge transport layer, includes a bonding resin comprising denatured polycarbonate resin, fluorine resin particles and a charge transport material.

(Double-Layered Charge Transport Layer)

First Charge Transport Layer

Where the charge transport layer comprises a first charge transport layer and a second transport layer that are sequentially stacked, the first charge transport layer includes a bonding resin and a charge transport material, and preferably such additives as an antioxidant, an electron receiving substance and silicone oil as well.

Because the second charge transport layer is formed on the first charge transport layer, and there is relatively little need for wear resistance and mechanical strength, the bonding resin for the first charge transport layer is not limited to any particular type of resin. It can be selected from among thermoplastic or heat-cured resins such as, for example, bisphenol A-type polycarbonate resin, bisphenol Z-type polycarbonate resin, styrene resin, styrene-acrylic resin, acrylic resin, polyester resin, polyvinyl chloride resin, polyvinyl acetate resin, polyvinylidene chloride resin, polyarylate resin, phenoxy resin, acetylcellulose resin, ethylcellulose resin, polyvinyl butyral, polyvinyl methylal, polyvinyl toluene, silicone resin, epoxy resin, melamine resin, urethane resin, phenol resin and alkyd resin. Because selection can be made from among relatively many resins for the bonding resin as shown above, the manufacturing cost can be further reduced by selecting an inexpensive resin. Among denatured polycarbonate resins, the relatively inexpensive bisphenol Z-type polycarbonate resin is used. Preferably, bisphenol A-type polycarbonate resin, styrene resin, styrene-acrylic resin or acrylic resin, which are even less expensive, are used.

The charge transport material for the first charge transport layer is not limited to any particular substance so long as it can move electron holes. Such substances include oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives and butadiene derivatives. The content of the charge transport material in the first charge transport layer relative to 100 parts by weight of the bonding resin is 40 to 280 parts by weight, and preferably 50 to 130 parts by weight.

For the antioxidant in the first charge transport layer, a monophenolic compound such as 2,6-di-t-butyl-p-cresol, butylated hydroxyanisole, 2,6-di-t-butyl-4-ethylphenol, stearyl-β-(3,5-di-t-butyl-4-hydroxyphenyl)propionate or 2,6-di-t-butyl-4(4,6-bis(octylthio)-1,3,5-triazine-2-ylamino) phenyl; a bisphenolic compound such as 2,2'-methylene-bis-(4-methyl-6-t-butylphenol), 2,2'-methylene-bis-(4-ethyle-6-t-butylphenol), 2,2'-methylene-bis-(4-ethyl-6-t-butylphenol), 4,4'-thiobis-(3-methyl-6-t-butylphenol), or 4,4' butylidenebis-(3-methyl-6-t-butylphenol); a copolymeric phenolic compound such as 1,1,3-tris-(2-methyl-4-hydroxy-5-t-butylphenyl)butane, 1,3,5-trimethyl-2,4,6-tris (3,5-di-t-butyl-4-hydroxybenzyl)benzene, tetrakis-[methylene-3-(3',5'-di-t-butyl-4'-hydroxyphenyl) propionate]methane, bis[3,3'-bis(4'-hydroxy- 3'-t-butylphenyl)butyric acid]glycol ester and tocopherols; a paraphenylene diamine such as N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine or N,N'-dimethyl-N,N'-di-t-butyl-p-phenylene diamine; a hydroquinone such as 2,5-di-t-octylhydroquinone, 2,6-didodecylhydroquinone, 2-dodecylhidroquinone, 2-dodecyl-5-chlorohydroquinone, 2-t-octyl-5-methylhydroquinone or 2-(2-octadecenyl)-5-methylhydroquinone; an organic sulfur compound such as dilauryl-3,3'-thiodipropionate, distearyl-3,3'-thiodipropionate or ditetradecyl-3,3'-thiopropionate; or an organic phosphate compound such as triphenyl phosphine, tri-(nonylphenyl)phosphine, tri-(dinonylphenyl)phosphine, tricresyl phosphine or tri-(2,4-dibutylphenoxy)phosphine may be used. In order to prevent an increase in residual potential during use over a long period of time, the content of the antioxidant relative to 100 parts by weight of the bonding resin in the first charge transport layer is 0.3 to 25 parts by weight, and preferably 0.8 to 13 parts by weight. The antioxidant may be added to the charge generating layer or to the sub-layer describe above.

A public-domain substance may be used as the electron receiving substance of the first charge transport layer. Such substances include hydrogen carbonate aromatic cyclic compounds having at least one electron attractant substituent such as 1,3-bis-(dicyanovinyl)-benzene; electron attractant aromatic heterocyclic compounds such as 4'-bisphenyl-4"-t-butylphenyl-2,5-oxadiazol; cyclic ketone compounds such as benzoquinone; lactone compounds such as phenanthrenebiscarbolactone; dicarboxylate anhydrides such as phthalic anhydride, dicarboxylate imides (the above dicarboxylate anhydrides subjected to imide substitution using a compound having a first-class amino group) such as N-methylphthalimide; and imidazolyl substituted dicarboxylate anhydride compounds (the above dicarboxylate anhydrides with which an imidazole ring was formed using a compound having a diamino group such as o-phylenediamine). The content of the electron receiving substance relative to 100 parts by weight of bonding resin in the first charge transport layer is 0.3 to 12 parts by weight, and preferably 0.5 to 7 parts by weight.

A public domain silicone oil can be used as the silicone oil of the first charge transport layer. For example, dimethyl silicone oil, methylphenyl silicone oil, polyether denatured silicone oil, fluorine denatured silicone oil or amino denatured silicone oil may be used. Dimethyl silicone oil is preferred. It is preferred that the silicone oil have a viscosity of 0.5 to 100 cp, and preferably 0.5 to 50 cp. The content of the silicone oil relative to 100 parts by weight of the bonding resin in the first charge transport layer is 0.001 to 0.5 parts by weight, and preferably 0.005 to 0.1 parts by weight.

Second Charge Transport Layer

The second charge transport layer, which is a surface layer formed on the first charge transport layer, includes a bonding resin comprising denatured polycarbonate resin, fluorine resin particles and a charge transport material, and preferably also includes an antioxidant, an electron receiving substance and a silicone oil.

The denatured polycarbonate resin that is used as the bonding resin of the second charge transport layer is selected from the group consisting of the denatured polycarbonates (I) through (IV) shown below.

The denatured polycarbonate (I) is a polycarbonate that has recurring units expressed by the following general formula (I).

(I)

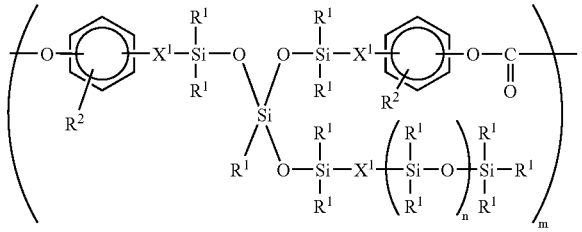

(In the formula, $R^1$ represents an alkyl group having a carbon number of 1 to 6, or a substituted or non-substituted aromatic carbon hydride group having a carbon number of 6 to 12, and preferably an alkyl group having a carbon number of 1 to 6, particularly a methyl group, and the multiple $R^1$'s may be identical to or different from each other. $R^2$ represents a hydrogen atom, a halogen atom, an alkyl group having a carbon number of 1 to 6, or a substituted or non-substituted aromatic carbon hydride group having a carbon number of 6 to 12, and preferably a hydrogen atom or an alkyl group having a carbon number of 1 to 6, particularly a hydrogen atom, and the multiple $R^2$'s may be identical to or different from each other. $X^1$ is $(CH_2)_k$, and the multiple $X^1$'s may be identical to or different from each other. (k) is an integer from 1 to 6, and preferably 2 or 3. (n) is an integer from 0 to 200, and preferably 5 to 100. (m) is an integer from 1 to 50.) In other words, the denatured polycarbonate (I) should include the recurring unit expressed by the general formula (I) shown above as one of the component units thereof.

A preferred specific example of the denatured polycarboante (I) is the denatured polycarbonate expressed by the general formula (I-1).

(I-1)

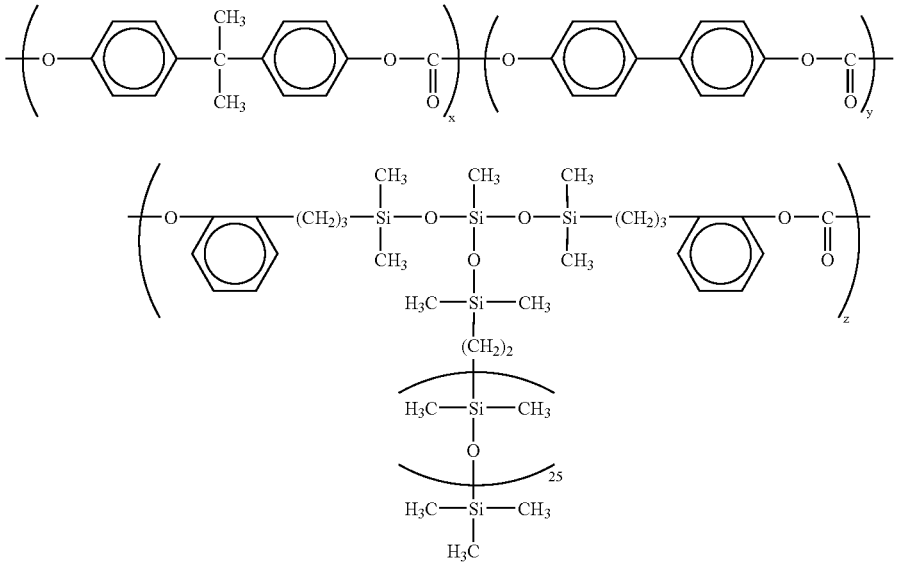

(In the formula, the ratio x/(x+y+z) is 0.5 to 0.95, and the ratio z/(x+y+z) is 0.0001 to 0.1.)

The viscosity-average molecular weight of the denatured polycarbonate (I) is preferably 20,000 to 100,000, and more preferably 30,000 to 80,000. By having a molecular weight in this range, the dispersibility of the fluorine resin particles described below further improves, resulting in increased image quality, wear resistance and separability.

For the denatured polycarboante (I), G-300, G-400 and G-700 (manufactured by Idemitsu Kosan Co., Ltd., x/(x+y+z)=0.85 and z/(x+y+z)=0.001 in the above general formula (I-1)), for example, are commercially available.

The denatured polycarbonate (II) is a polycarbonate that is expressed by the following general formula (II).

(II)

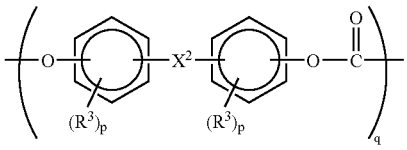

(In the formula, $R^3$ represents an a halogen atom, an alkyl group having a carbon number of 1 to 6, or a substituted or non-substituted aromatic carbon hydride group having a carbon number of 6 to 12, and the multiple $R^3$'s may be identical to or different from each other. (p) is an integer from 0 to 4, and the multiple (p)'s may be identical to or different from each other. $X^2$ is a 1,1-cycloalkylene group, —$C(CF_3)(CF_3)$—, or —$C(R^4)(R^5)$— (where at least either $R^4$ or $R^5$ is a substituted or non-substituted aromatic carbon hydride group having a carbon number of 6 to 12, and the other is a hydrogen atom or an alkyl group having a carbon number of 2 to 6), and preferably a polycarbonate expressed by:

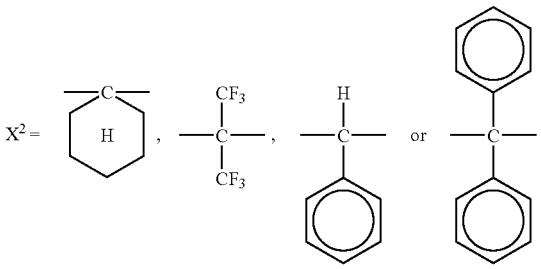

In other words, the denatured polycarbonate (II) comprises only recurring units expressed by the above general formula (II).

Preferred specific examples of the denatured polycarbonate (II) include denatured polycarbonates expressed by the general formulae (II-1) through (II-4):

(II-1)

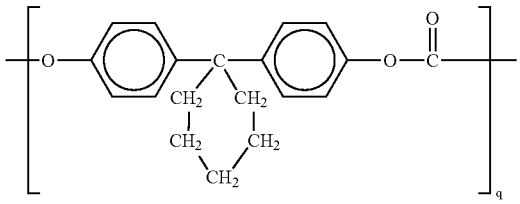

(II-2)

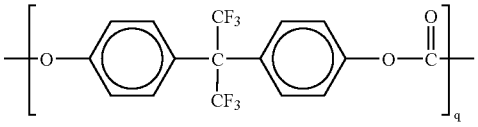

(II-3)

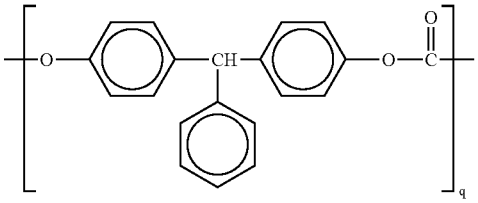

(II-4)

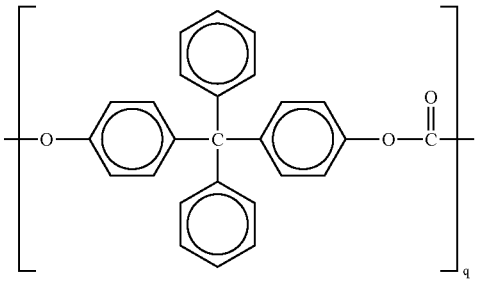

The viscosity-average molecular weight of the denatured polycarbonate (II) is preferably 20,000 to 100,000, and more preferably 30,000 to 80,000. By having a molecular weight in this range, the dispersibility of the fluorine resin particles described below further improves, resulting in increased image quality, wear resistance and separability.

For the denatured polycarbonate (II), TS2050 (manufactured by Teijin Chemicals Co., Ltd., and expressed by the above general formula (II-1)) and IUPILON Z500 (manufactured by Mitsubishi Engineering-Plastics Corporation, and expressed by the above general formula (II-1)), for example, are commercially available.

The denatured polycarbonate (III) is a polycarbonate that is expressed by the following general formula (III):

(III)

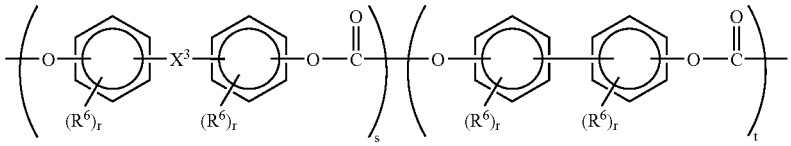

(In the formula, $R^6$ represents a halogen atom, an alkyl group having a carbon number of 1 to 6, or a substituted or non-substituted aromatic carbon hydride group having a carbon number of 6 to 12, and the multiple $R^6$'s may be identical to or different from each other. (r) is an integer from 0 to 4, and the multiple (r)'s may be identical to or different from each other. (s) is an integer from 0 to 50. (t) is an integer from 5 to 100. $X^3$ is a 1,1-cycloalkylene group, —$C(CF_3)(CF_3)$—, —O—, —$SO_2$— or —$C(R^7)(R^8)$— (where $R^7$ and $R^8$ are each a hydrogen atom, an alkyl group having a carbon number of 1 to 6 or a substituted or non-substituted aromatic carbon hydride group having a carbon number of 6 to 12, and the multiple $R^7$'s and $R^8$'s may be identical to or different from each other, respectively), and preferably).

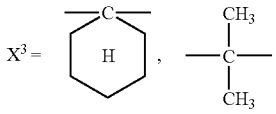

In other words, the denatured polycarbonate (III) comprises only recurring units expressed by the above general formula (III).

Preferred specific examples of the denatured polycarbonate (III) include denatured polycarbonates expressed by the general formulae (III-1) through (III-17):

(III-1)

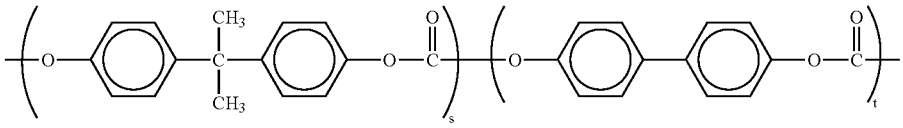

(III-2)

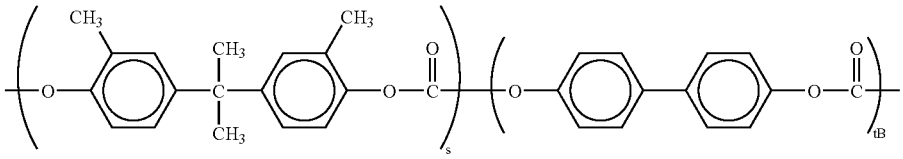

(III-3)

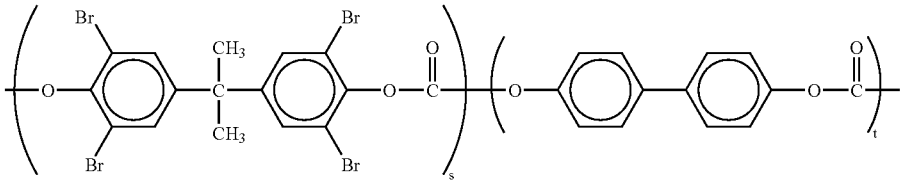

(III-4)

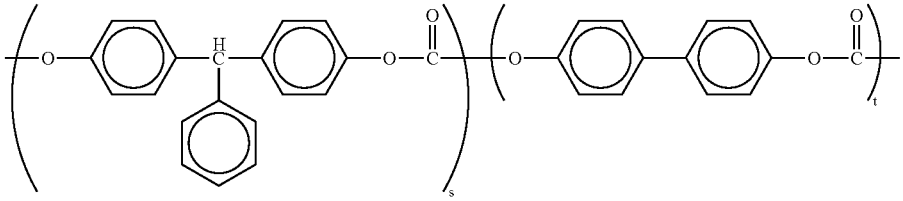

(III-5)

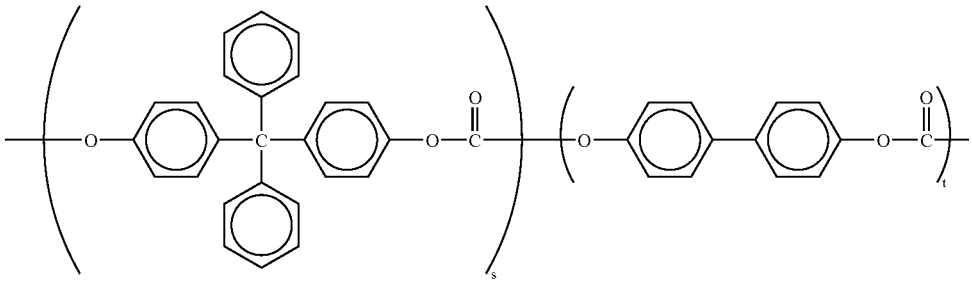

(III-6)

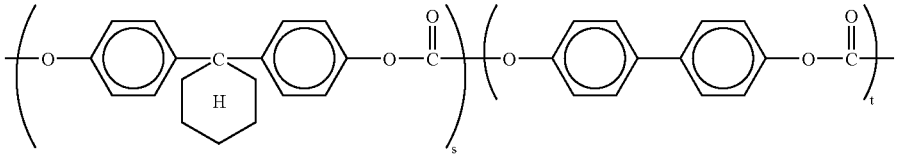

-continued
(III-7)
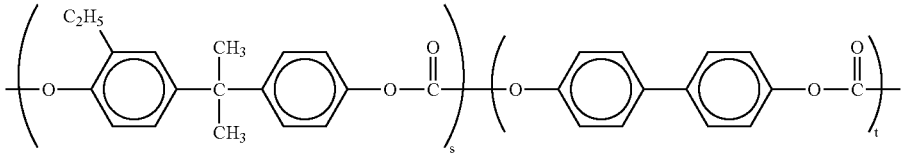
(III-8)
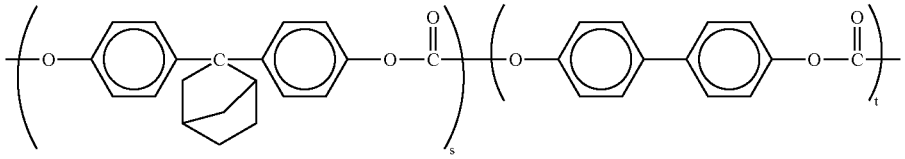
(III-9)
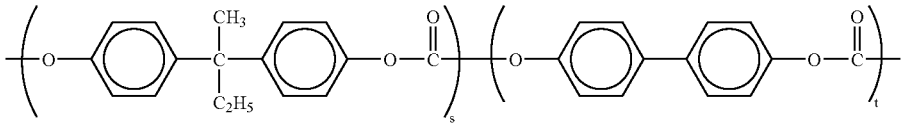
(III-10)
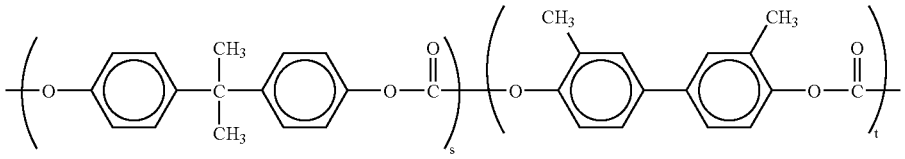
(III-11)
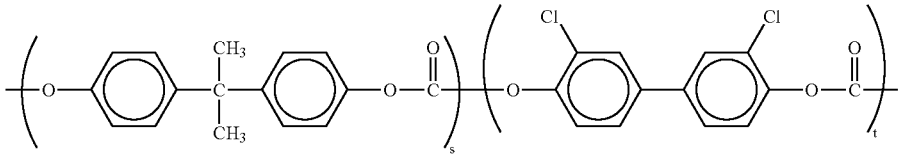
(III-12)
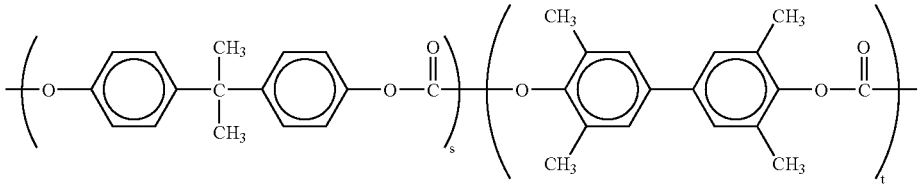
(III-13)
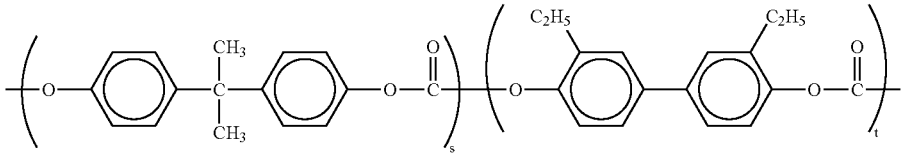
(III-14)
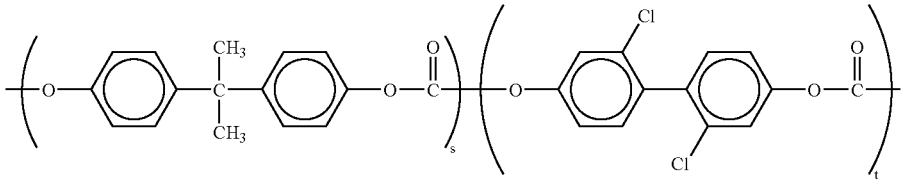
(III-15)
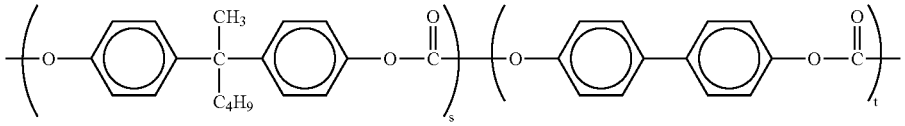

-continued (III-16)

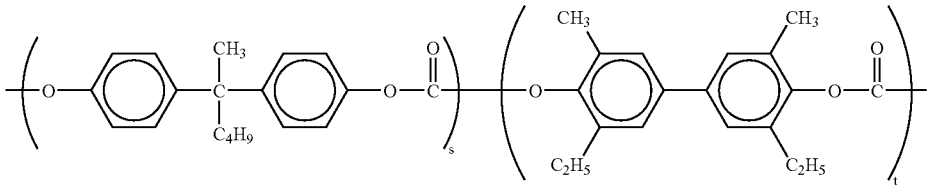

(III-17)

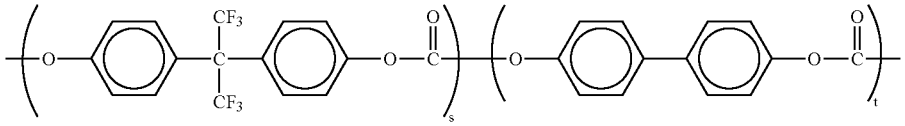

The viscosity-average molecular weight of the denatured polycarbonate (III) is preferably 20,000 to 100,000, and more preferably 30,000 to 80,000. By having a molecular weight in this range, the dispersibility of the fluorine resin particles described below further improves, resulting in increased image quality, wear resistance and separability.

For the denatured polycarboante (III), BPPC (manufactured by Idemitsu Kosan Co., Ltd., and expressed by the above general formula (III-1)), for example, is commercially available.

The denatured polycarbonate (IV) is a polycarbonate that has recurring units expressed by the following general formula (IV):

(IV)

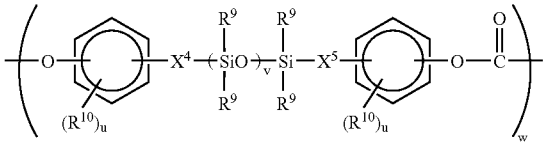

(In the formula, $R^9$ represents an alkyl group having a carbon number of 1 to 6, or a substituted or non-substituted aromatic carbon hydride group having a carbon number of 6 to 12, and preferably an alkyl group having a carbon number of 1 to 6, an methyl group or a phenyl group in particular, and the multiple $R^9$'s may be identical to or different from each other. $R^{10}$ represents a halogen atom, an alkyl group having a carbon number 1 to 6, or a substituted or non-substituted aromatic carbon hydride group having a carbon number of 6 to 12, and the multiple $R^{10}$ may be identical or different from each other. $X^4$ and $X^5$ are each $(CH_2)_h$, and the respective multiple $X^4$'s and $X^5$'s may be identical to or different from each other. (h) is an integer from 1 to 6, and preferably from 1 to 3. (u) is an integer from 0 through 4, and the multiple (u)'s may be identical to or different from each other. (v) is an integer from 1 to 150, and preferably from 10 to 50. (w) is an integer from 1 to 50.) In other words, the denatured polycarbonate (IV) should include the recurring unit expressed by the general formula (IV) shown above as one of the component units thereof.

Preferred specific examples of the denatured polycarbonate (IV) include denatured polycarbonates expressed by the general formulae (IV-1) through (IV-5):

(IV-1)

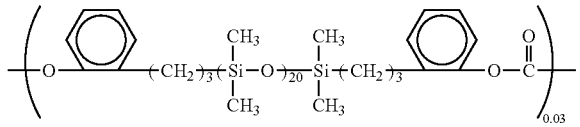

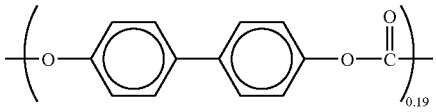

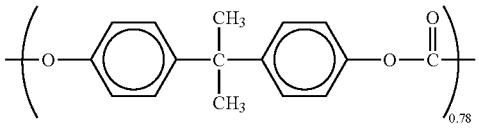

(IV-2)

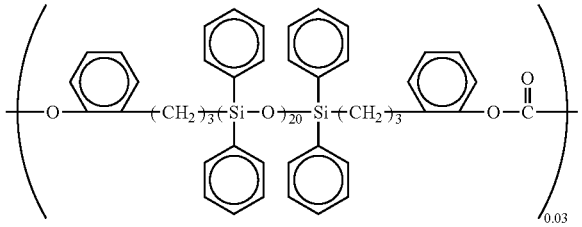

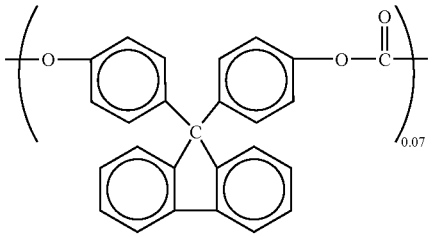

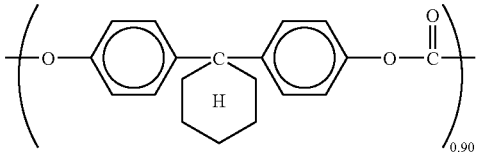

-continued (IV-3)

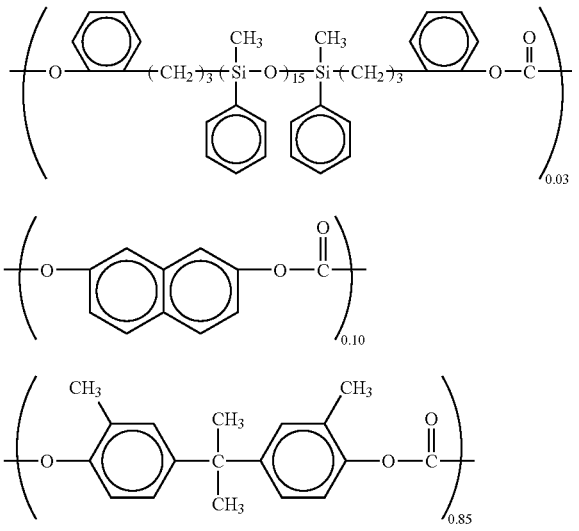

(IV-4)

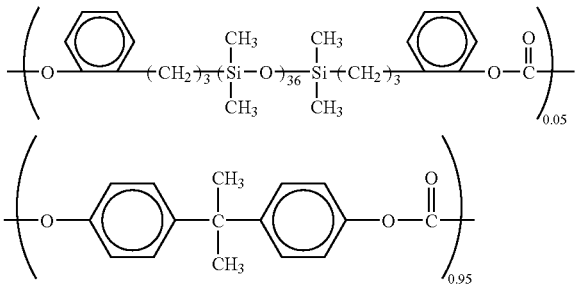

(IV-5)

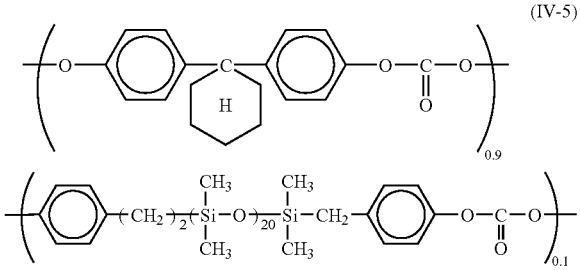

The viscosity-average molecular weight of the denatured polycarbonate (IV) is preferably 20,000 to 100,000, and more preferably 30,000 to 80,000. By having a molecular weight in this range, the dispersibility of the fluorine resin particles described below further improves, resulting in increased image quality, wear resistance and separability.

The fluorine resin particles in the second charge transport layer are particles comprising a polymer of a fluorine polymerized monomer or particles comprising a copolymer of a fluorine polymerized monomer and a fluorine-free polymerized monomer. A fluorine polymerized monomer is a monomer expressed by the, general formula:

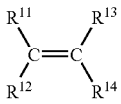

(In the formula, at least one of the $R^{11}$ through $R^{14}$ groups is a fluorine atom, and the other groups are respectively a hydrogen atom, a chlorine atom, a methyl group, a monofluoromethyl group, a difluoromethyl group or a trifluoromethyl group). Preferred fluorine polymerized monomers include ethylene tetrafluoride, ethylene trifluoride, propylene hexafluoride, vinyl fluoride, vinylidene fluoride and ethylene difluoride dichloride. Two or more monomers may be used as the fluorine polymerized monomer.

One example of the fluorine-free polymerized monomer is vinyl chloride. It is also acceptable if two or more monomers are used for the fluorine-free polymerized monomer.

A preferred specific example of the fluorine resin particles is polytetrafluoroethylene (PTFE).

The average molecular weight of the resin that is used to obtain fluorine resin particles is 100,000 to 5,000,000, and preferably 100,000 to 1,000,000, in order to further improve the separability and wear resistance.

The average particle diameter of the fluorine resin particle is 0.4 μm or less, preferably 0.01 to 0.4 μm, and more preferably 0.05 to 0.3 μm in order to ensure clarity of the surface layer.

The content of the fluorine resin particles in the second charge transport layer should be such that 'the content (parts by weight) thereof relative to 100 parts by weight of the bonding resin of the second charge transport layer'×'thickness (μm) of the second charge transport layer' is 200 to 1,500, preferably 300 to 1,000, and more preferably 500 to 800, in order to further improve slidability (separability) and wear resistance and to ensure clarity of the layer. Here, the 'bonding resin' of the second charge transport layer means denatured polycarbonate resin, and where this layer includes resins other than polycarbonate resin, the term means 'the mixture of these bonding resins'.

For the charge transport material, antioxidant, electron receiving substance and silicone oil of the second charge transport layer, those that are the same as the specific examples of each material that were shown in the description of the first charge transport layer can be used.

The content of the charge transport material relative to 100 parts by weight of the bonding resin of the second charge transport layer is 45 to 300, and preferably 55 to 150. In the present invention, if the content of the charge transport material relative to the bonding resin in the second charge transport layer is larger than the content of the charge transport material relative to the bonding resin in the first charge transport layer, good image quality can be maintained over a long period of time. More specifically, image noise such as fogging and reduced resolution can be effectively prevented for a long period of time. This is thought to be possible due to the fact that the hole transport problem caused by the fluorine resin particles can be effectively prevented by the inclusion of such content. From this standpoint, it is desirable that the content of the charge transport material relative to 100 parts by weight of the bonding resin in the second charge transport layer be more than the content of the charge transport material relative to 100 parts by weight of the bonding resin in the first charge transport layer by five parts by weight or more, preferably 5 to 150 parts by weight, and more preferably 10 to 100 parts by weight.

The content of the antioxidant relative to 100 parts by weight of the bonding resin in the second charge transport layer is 0.5 to 30 parts by weight, and preferably 1 to 15 parts by weight. In the present invention, if the content of the antioxidant relative to the bonding resin in the second charge transport layer is larger than the content of the antioxidant relative to the bonding resin in the first charge transport layer, image noise such as fogging and reduced resolution can be prevented for an even longer period of time. This is because while the charge transport material of the second charge transport layer is subject to oxidization because it is not easily worn off and is used for a long period of time, since the second charge transport layer including fluorine resin particles has good wear resistance, the deterioration due to oxidization of the charge transport material of the second charge transport layer can be effectively prevented when the antioxidant content is as indicated above. Therefore, it is desirable that the content of the antioxidant relative to 100 parts by weight of the bonding resin in the second charge transport layer be larger than the content of the antioxidant relative to 100 parts by weight of the bonding resin in the first charge transport layer by 0.1 parts by weight or more, preferably 0.1 to 10 parts by weight, and more preferably 0.5 to 5 parts by weight.

In another embodiment of the invention, the second charge transport layer is formed on the first charge transport layer and contains a first charge transport layer that is formed on a charge generating layer and contains a first bonding resin and a first charge transport material; and contains a second bonding resin including denatured polycarbonate resin, fluorine resin particles and a second charge transport material. The content of the second charge transport material relative to. said second bonding resin is larger than the content of the first charge transport material relative to said first bonding resin.

The content of the electron receiving substance relative to 100 parts by weight of the bonding resin in the second charge transport layer is 0.1 to 10 parts by weight, and preferably 0.3 to 5 parts by weight. In the present invention, it is preferred that the content of the electron receiving substance in the first charge transport layer be increased in order to prevent an increase in residual potential caused by long-term use, and that the content of the electron receiving substance in the second charge transport layer be reduced in order to prevent a reduction in resolution caused by long-term use, and therefore that the content of the electron receiving substance relative to the bonding resin in the second charge transport layer be smaller than the content of the electron receiving substance relative to the bonding resin in the first charge transport layer. From this standpoint, it is desirable that the content of the electron receiving substance relative to 100 parts by weight of the bonding resin in the second charge transport layer be smaller than the content of the electron receiving subsistence relative to 100 parts by weight of the bonding resin in the first charge transport layer by 0.1 parts by weight or more, preferably 0.1 to 5 parts by weight, and more preferably 0.5 to 2 parts by weight.

Regarding the content of the silicone oil in the second charge transport layer, 'the first charge transport layer' should be replaced by 'the second charge transport layer' such that the silicone oil content in the first charge transport layer is applied in the second charge transport layer as well.

A resin other than the denatured polycarbonate resins described above may be included in the bonding resin of the second charge transport layer. Such resins include bisphenol A-type polycarbonate resin, styrene resin, acrylic resin and styrene-acrylic resin. The content of resins other than the denatured polycarbonate resin should be no more than 50 percent of the denatured polycarbonate resin by weight. If such content exceeds 50 percent by weight, the dispersibility-improving effect of the fluorine resin particles cannot be adequately attained.

The thickness of the second charge transport layer is 3 to 15 μm, preferably 6 to 12 μm, and the combined thickness of the first and second charge transfer layers is 18 to 35 μm, and preferably 25 to 30 μm.

(m-layered charge transport layer (m is an integer equal to or higher than 3)

Where the charge transport layer comprises (m) number of layers, i.e., a first charge transport layer, a second charge transport layer, etc., up to an mth charge transport layer, the mth charge transport layer is identical to the second charge transport layer of the double-layered charge transport layer. In this case, the first to (m-1)th charge transport layers are identical to the first charge transport layer of the double-layered charge transport layer with the exception that their combined thickness is 18 to 35 μm, and preferably 25 to 30 μm.

Each charge transport layer can be obtained by applying a charge transport solution that is obtained by dissolving or dispersing prescribed materials in an appropriate solvent according to prescribed ratios and drying the solution thereon. For the solvent, tetrahydrofuran, acetone, toluene, dioxisan, dioxolane or methyl chloride, for example, may be used. For the application, any of the methods employed to apply the charge-generating layer solution can be used.

EXAMPLES

Example 1

In this example, a conductive support unit comprising a cylindrical aluminum tube having a 30 mm outer diameter and a 350 mm length was used.

A sub-layer solution was prepared by adding 5 parts by weight of polyamide resin (CM8000, manufactured by Toray Industries, Inc.) and 5 parts by weight of titanium oxide (CR-90, manufactured by Ishihara Sangyo Kaisha, Ltd.) to 90 parts by weight of methanol and dispersing them therein for two hours using a sand mill. This application solution was applied on the conductive support unit via immersion to form a 2 μm-thick sub-layer.

One part by weight of butyral resin (S-LEC BX-1, manufactured by Sekisui Chemical Co., Ltd.) and one part by weight of m-type titanyl phthalocyanine (am-TiOPc, manufactured by Toyo Ink Manufacturing Co., Ltd.) were then added to 100 parts by weight of tetrahydrofuran and dispersed therein for five hours using a sand mill, whereupon a charge generating layer solution was prepared. This charge generating layer solution was applied to the sub-layer described above via immersion to form a 0.2 μm-thick charge generating layer.

A first charge transport layer solution was prepared by dissolving 10 parts by weight of styrene-acrylate resin (MS200, manufactured by Nippon Steel Chemical Co., Ltd.), 8 parts by weight of a charge transport material expressed by the general formula (i) shown below,

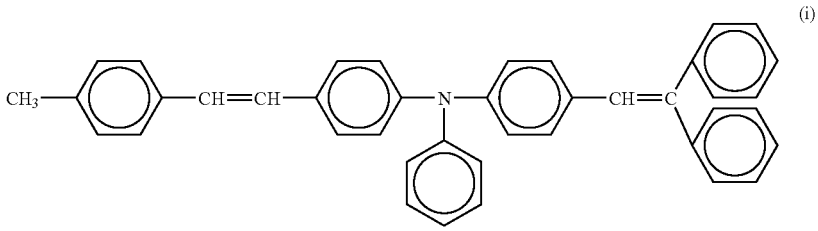

(i)

0.5 parts by weight of an antioxidant expressed by the general formula (ii) shown below,

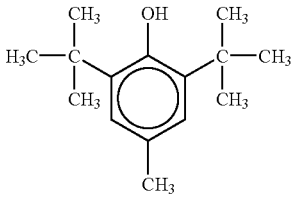

(ii)

0.3 parts by weight of an electron receiving substance expressed by the general formula (iii) shown below,

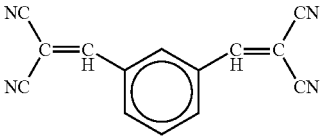

(iii)

and 0.001 parts by weight of dimethyl silicone oil (KF96, manufactured by Shin-Etsu Chemical Co., Ltd., viscosity 10 cp) into 100 parts by weight of tetrahydrofuran. This charge transport layer solution was applied onto the charge generating layer via immersion and dried thereon for twenty minutes at 60° C. to form a first charge transport layer having a 20 μm thickness.

Furthermore, after dissolving 10 parts by weight of polycarbonate resin containing polydialkyl siloxane (G-400, manufactured by Idemitsu Kosan Co., Ltd., viscosity-average molecular weight 40,000), 12 parts by weight of a charge transport material expressed by the above general formula (i), one part by weight of an antioxidant expressed by the above general formula (ii), 0.1 parts by weight of an electron receiving substance expressed by the above general formula (iii), and 0.001 parts by weight of dimetyl silicone oil (KF96, manufactured by Shin-Etsu Chemical Co., Ltd., viscosity 10 cp), 25 parts by weight of a PTFE-dispersed toluene solution (KD600AS, manufactured by Kitamura Ltd., average particle diameter 0.3 μm, containing 40% by weight of PTFE) was added and ultrasonically dispersed in the solution for 30 minutes, whereupon a second charge transport layer solution was prepared. This charge transport layer solution was applied onto the above first charge transport layer using the ring application method, and was dried thereon at 120° C. for 40 minutes to form a second charge transport layer having a 6 μm thickness, whereupon a function-separated photoreceptor unit for electrophotography was obtained.

Example 2

A photoreceptor unit for electrophotography was prepared using the same method as for the example 1, except for that the styrene-acrylate resin used for the first charge transport layer in the example 1 was substituted with bisphenol A-type polycarbonate resin (K1300, manufactured by Teijin Chemicals, Ltd.).

Example 3

A photoreceptor unit for electrophotography was prepared using the same method as for the example 1, except for that the styrene-acrylate resin used for the first charge transport layer in the example 1 was substituted with styrene resin (STYRON 679, manufactured by Asahi Kasei Corporation), and the polycarbonate resin used for the second charge transport layer was substituted with G-700 (manufactured by Idemitsu Kosan Co., Ltd., viscosity-average molecular weight 70,000).

Example 4

A photoreceptor unit for electrophotography was prepared using the same method as for the example 1, except for that the polycarboante resin used for the second charge transport layer in the example 1 was substituted with bisphenol Z-type polycarbonate resin (TS2050, manufactured by Teijin Chemicals, Ltd., viscosity-average molecular weight 50,000).

Example 5

A photoreceptor unit for electrophotography was prepared using the same method as for the example 1, except for that the styrene-acrylate resin used for the first charge transport layer in the example 1 was substituted with bisphenol Z-type polycarbonate resin (IUPILON Z200, manufactured by Mitsubishi Engineering-Plastics Corporation, viscosity-average molecular weight 20,000), and the polycarbonate resin used for the second charge transport layer was substituted with bisphenol Z-type polycarboante resin (IUPILON Z500, manufactured by Mitsubishi Engineering-Plastics Corporation, viscosity-average molecular weight 50,000).

Comparison Example 1

A photoreceptor unit for electrophotography was prepared using the same method as for the example 1, except for that the thickness of the first charge transport layer was made 26 μm and no second charge transport layer was formed.

Comparison Example 2

A photoreceptor unit for electrophotography was prepared using the same method as for the example 1, except for that the amount of the charge transport material in the second charge transport layer was made 8 parts by weight.

Comparison Example 3

A photoreceptor unit for electrophotography was prepared using the same method as for the example 1, except for that no PTFE-dispersed solution was added to the second charge transport layer.

Comparison Example 4

A photoreceptor unit for electrophotography was prepared using the same method as for the example 2, except for that the polycarbonate resin used for the second charge transport layer was substituted with bisphenol A-type polycarbonate resin (K1300, manufactured by Teijin Chemicals Ltd., viscosity-average molecular weight 30,000).

Each photoreceptor unit thus obtained was mounted in a commercially available color copying machine (CF2001, manufactured by Minolta Co., Ltd.), and was evaluated regarding the following items.

(Amount of Wear)

10,000 continues copies were made, and the amount of wear was sought by measuring the photoreceptor unit before and after the copying at the top, the middle and the bottom, and taking the average of such wear.

(Image Noise)

For the image noise, 10,000 continuous copies were made, and the image fog and missing dots before and after copying were visually checked.

Image Fog

○: No

X: Yes

Missing Dots

○: No

Δ: 1–20%

X: 21–40%

XX: 41% or more (Application Solution Dispersibility)

To determine the application solution dispersibility, the second charge transport layer solution was left untouched for a week, a photoreceptor unit was prepared using this solution, and the number of foreign items (coagulated matter) on the photoreceptor unit was visually checked.

○: No foreign items (coagulated matter)

Δ: 1–9 foreign items

X: 10 or more foreign items

TABLE 1

| | Amount of wear (μm) | Image noise (fog) Initially | Image noise (fog) After printing 10,000 sheets | Image nosie (missing dots) Initially | Image nosie (missing dots) After printing 10,000 sheets | Application solution dispersibility |
|---|---|---|---|---|---|---|
| Example 1 | 1.3 | ○ | ○ | ○ | ○ | ○ |
| Example 2 | 1.5 | ○ | ○ | ○ | ○ | ○ |
| Example 3 | 1.2 | ○ | ○ | ○ | ○ | ○ |
| Example 4 | 1.3 | ○ | ○ | ○ | ○ | ○ |

TABLE 1-continued

| | Amount of wear (μm) | Image noise (fog) Initially | Image noise (fog) After printing 10,000 sheets | Image nosie (missing dots) Initially | Image nosie (missing dots) After printing 10,000 sheets | Application solution dispersibility |
|---|---|---|---|---|---|---|
| Example 5 | 1.5 | ○ | ○ | ○ | ○ | ○ |
| Comparison example 1 | 12.8 | ○ | X | ○ | X X | ○ |
| Comparison example 2 | 1.3 | ○ | X | ○ | ○ | ○ |
| Comparison example 3 | 12.8 | ○ | X | ○ | X X | ○ |
| Comparison example 4 | — | — | — | — | — | X |

Note: Because coagulated matter was present on the surface of the photoreceptor unit of the comparison example 4, evaluation was not performed regarding the amount of wear and image noise.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. An organic photoreceptor unit comprising:

a conductive base unit;

a charge generating layer formed on said conductive base unit;

a first charge transport layer that is formed on said charge generating layer and contains a first bonding resin and a first charge transport material; and a second charge transport layer that is formed on said first charge transport layer and contains a second bonding resin including polycarbonate resin having recurring units represented by general formulas I, II, III or IV, fluorine resin particles and a second charge transport material, wherein the content of the second charge transport material relative to said second bonding resin is larger than the content of the first charge transport material relative to said first bonding resin; and wherein said first charge transport layer and said second charge transport layer each contain an antioxidant, and the content of the antioxidant relative to said second bonding resin is larger than the content of the antioxidant relative to said first bonding resin and within the range of 0.5 to 30 parts by weight per 100 parts by weight of the second bonding resin:

(I)

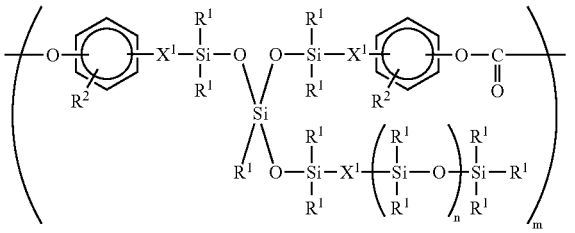

wherein, $R^1$ represents an alkyl group having a carbon number of 1 to 6, or a substituted or non-substituted aromatic hydrocarbon group having a carbon number of 6 to 12, and the multiple $R^1$'s may be identical to or different from each other: $R^2$ represents a hydrogen atom, a halogen atom, an alkyl group having a carbon number of 1 to 6, or a substituted or non-substituted aromatic hydrocarbon group having a carbon number of 6 to 12, and the multiple $R^2$'s may be identical to or different from each other; $X^1$ is $(CH_2)_k$, and the multiple $X^1$'s may be identical to or different from each other; (k) is an integer from 1 to 6; (n) is an integer from 0 to 200; and (in) is an integer from 1 to 50;

(II)

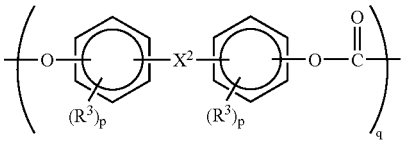

wherein $R^3$ represents a halogen atom, an alkyl group having a carbon number of 1 to 6, or a substituted or non-substituted aromatic hydrocarbon group having a carbon number of 6 to 12, and the multiple $R^3$'s may be identical to or different from each other; (p) is an integer from 0 to 4, and the multiple (p)'s may be identical to or different from each other; $X^2$ is a 1,1-cycloalkylene group, —$C(CF_3)(CF_3)$—, or —$C(R^4)(R^5)$—(where $R^4$ is a substituted or non-substituted aromatic hydrocarbon group having a carbon number of 6 to 12, and $R^5$ is a substituted or non-substituted aromatic hydrocarbon group having a carbon number of 6 to 12, a hydrogen atom or an alkyl group having a carbon number of 2 to 6);

(III)

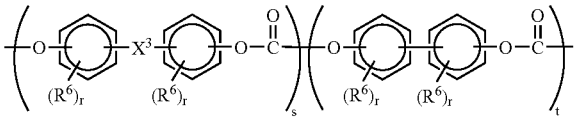

wherein, $R^6$ represents a halogen atom, an alkyl group having a carbon number of 1 to 6, or a substituted or non-substituted aromatic hydrocarbon group having a carbon number of 6 to 12, and the multiple $R^6$'s may be identical to or different from each other; (r) is an integer from 0 to 4, and the multiple (r)'s may be identical to or different from each other; (s) is an integer from 0 to 50; (t) is an integer from 5 to 100; and $X^3$ is a 1,1-cycloalkylene group, —$C(CF_3)(CF_3)$—, O—, —$SO_2$—or —$C(R^7)(R^8)$— (where $R^7$ and $R^8$ are each an hydrogen atom, an alkyl group having a carbon number of 1 to 6 or a substituted or non-substituted aromatic hydrocarbon group having a carbon number of 6 to 12);

(IV)

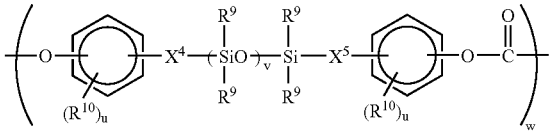

wherein, $R^9$ represents an alkyl group having a carbon number of 1 to 6, or a substituted or non-substituted aromatic hydrocarbon group having a carbon number of 6 to 12, and the multiple $R^9$'s may be identical to or different from each other; $R^{10}$ represents a halogen atom, an alkyl group having a carbon number of 1 to 6, or a substituted or non-substituted aromatic hydrocarbon group having a carbon number of 6 to 12, and the multiple $R^{10}$'s may be identical to or different from each other; $X^4$ and $X^5$ are each $(CH_2)_h$, and the multiple $X^4$'s and $X^5$'s may be identical to or different from each other, respectively; (h) is an integer from 1 to 6, (u) is an integer from 0 through 4, and the multiple (u)'s may be identical to or different from each other; (v) is an integer from 1 to 150; and (w) is an integer from 1 to 50.

2. The organic photoreceptor unit according to claim 1, wherein the thickness of said second charge transport layer is 3 to 15 μm, and the combined thickness of said first charge transport layer and said second charge transport layer is 18 to 35 μm.

3. The organic photoreceptor unit according to claim 1, wherein said first bonding resin comprises at least one resin that is selected from a group consisting of styrene resin, acrylic resin, styrene-acrylic resin, bisphenol A polycarbonate resin and bisphenol Z polycarbonate resin.

4. The organic photoreceptor unit according to claim 1, wherein said first charge transport layer and said second charge transport layer each contain an electron receiving substance, and the content of the electron receiving substance relative to said second bonding resin is smaller than the content of the electron receiving substance relative to said first bonding resin and within the range of 0.1 to 10 parts by weight per 100 parts by weight of the second bonding resin.

5. The organic photoreceptor unit according to claim 1, wherein said first charge transport layer and said second charge transport layer each contain silicone oil.

6. The organic photoreceptor unit according to claim 1, wherein the product (M×T) of the content M of said fluorine resin particles relative to 100 parts by weight of said second bonding resin and the thickness T of said second charge transport layer is 200 to 1,500.

7. The organic photoreceptor unit according to claim 1, wherein said fluorine resin particles have an average particle diameter of 0.4 μm or less.

8. The organic photoreceptor unit according to claim 1, wherein said polycarbonate resin is a polycarbonate resin expressed by a general formula (I-1):

(I-1)

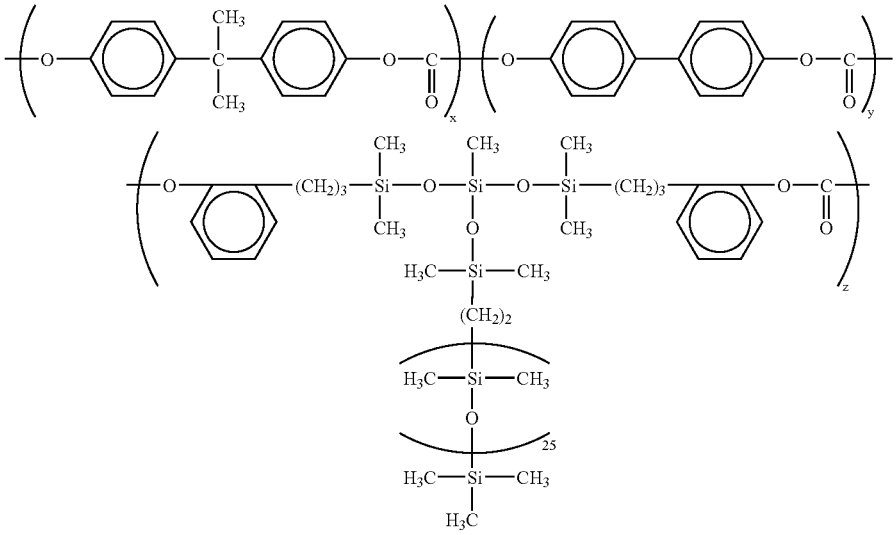

wherein the ratio x(x+y+z) is 0.5 to 0.95, and the ratio z/(x+y+z) is 0.0001 to 0.1.

9. The organic photoreceptor unit according to claim 1, wherein said polycarbonate resin is a polycarbonate resin having recurring units expressed by a general formula (II-1):

(II-1)

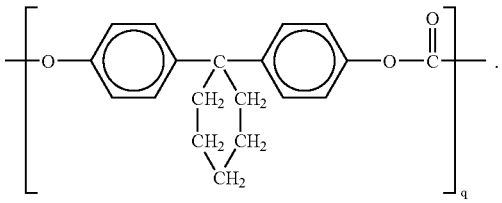

10. The oraanic photoreceptor unit according to claim 1, further comprising a sub-layer on said conductive base unit wherein said charge generating layer is formed on said sub-layer.

11. The organic photoreceptor unit according to claim 10, wherein the thickness of said second charge transport layer is 3 to 15 μm, and the combined thickness of said first charge transport layer and said second charge transport layer is 18 to 35 μm.

12. The organic photoreceptor unit according to claim 10, wherein said first bonding resin comprises at least one resin that is selected from a group consisting of styrene resin, acrylic resin, styrene-acrylic resin, bisphenol A polycarbonate resin and bisphenol Z polycarbonate resin.

13. The organic photoreceptor unit according to claim 10, wherein said first charge transport layer and said second charge transport layer each contain an electron receiving substance, and the content of the electron receiving substance relative to said second bonding resin is smaller than the content of the electron receiving substance relative to said first bonding resin and within the range of 0.1 to 10 parts by weight per 100 parts by weight of the second bonding resin.

14. The organic photoreceptor unit according to claim 10, wherein said first charge transport layer and said second charge transport layer each contain silicone oil.

15. The organic photoreceptor unit according to claim 1, wherein said polycarbonate resin is a polycarbonate resin having recurring units expressed by the general formula (I).

16. The organic photoreceptor unit according to claim 1, wherein said polycarbonate resin is a polycarbonate resin having recurring units expressed by the general formula (II).

17. The organic photoreceptor unit according to claim 1, wherein said polycarbonate resin is a polycarbonate resin having recurring units expressed by the general formula (III).

18. The organic photoreceptor unit according to claim 1, wherein said polycarbonate resin is a polycarbonate resin having recurring units expressed by the general formula (IV).

19. An organic photoreceptor unit comprising:

a conductive base unit;

a charge generating layer formed on said conductive base unit;

a first charge transport layer that is formed on said charge generating layer and contains a first bonding resin and a first charge transport material; and a second charge transport layer that is formed on said first charge transport layer and contains a second bonding resin including polycarbonate resin having recurring units represented by general formulas I, II, III or IV, fluorine resin particles and a second charge transport material, wherein the content of the second charge transport material relative to said second bonding resin is larger than the content of the first charge transport material relative to said first bonding resin; and wherein said first charge transport layer and said second charge transport layer each contain an electron receiving substance, and the content of the electron receiving substance relative to said second bonding resin is smaller than the content of the electron receiving substance relative to said first bonding resin and within the range of 0.1 to 10 parts by weight per 100 parts by weight of the second bonding resin:

(I)

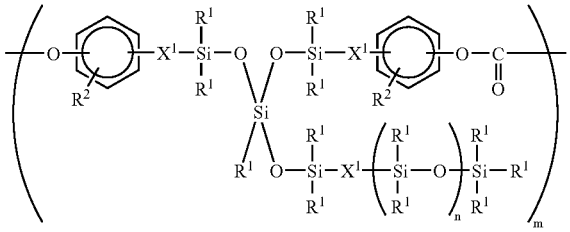

wherein, $R^1$ represents an alkyl group having a carbon number of 1 to 6, or a substituted or non-substituted aromatic hydrocarbon group having a carbon number of 6 to 12, and the multiple $R^1$'s may be identical to or different from each other; $R^2$ represents a hydrogen atom, a halogen atom, an alkyl group having a carbon number of 1 to 6, or a substituted or non-substituted aromatic hydrocarbon group having a carbon number of 6 to 12, and the multiple $R^2$'s may be identical to or different from each other; $X^1$ is $(CH_2)_k$, and the multiple $X^1$'s may be identical to or different from each other; (k) is an integer from 1 to 6; (n) is an integer from 0 to 200; and (m) is an integer from 1 to 50;

(II)

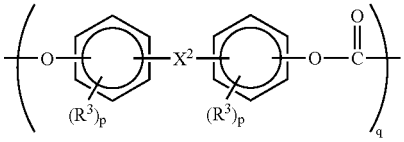

wherein $R^3$ represents a halogen atom, an alkyl group having a carbon number of 1 to 6, or a substituted or non-substituted aromatic hydrocarbon group having a carbon number of 6 to 12, and the multiple $R^3$'s may be identical to or different from each other; (p) is an integer from 0 to 4, and the multiple (p)'s may be identical to or different from each other; $X^2$ is a 1,1-cycloalkylene group, $—C(CF_3)(CF_3)—$, or $—C(R^4)(R^5)—$ (where $R^4$ is a substituted or non-substituted aromatic hydrocarbon group having a carbon number of 6 to 12, and R5 is a substituted or non-substituted aromatic hydrocarbon group having a carbon number of 6 to 12, a hydrogen atom or an alkyl group having a carbon number of 2 to 6);

(III)

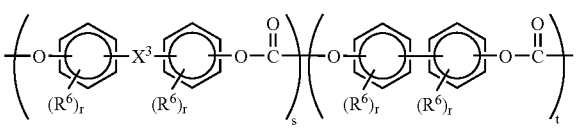

wherein, $R^6$ represents a halogen atom, an alkyl group having a carbon number of 1 to 6, or a substituted or non-substituted aromatic hydrocarbon group having a carbon number of 6 to 12, and the multiple $R^6$'s may be identical to or different from each other; (r) is an integer from 0 to 4, and the multiple (r)'s may be identical to or different from each other; (s) is an integer from 0 to 50; (t) is an integer from 5 to 100; and $X^3$ is a 1,1-cycloalkylene group, $—C(CF_3)(CF_3)—$, —O—, $—SO_2—$ or $—C(R^7)(R^8)—$ (where $R^7$ and $R^8$ are each an hydrogen atom, an alkyl group having a carbon number of 1 to 6 or a substituted or non-substituted aromatic hydrocarbon group having a carbon number of 6 to 12);

(IV)

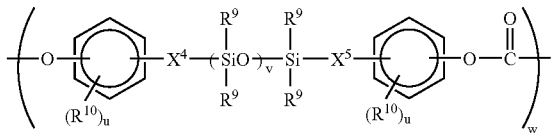

wherein, $R^9$ represents an alkyl group having a carbon number of 1 to 6, or a substituted or non-substituted aromatic hydrocarbon group having a carbon number of 6 to 12, and the multiple $R^9$'s may be identical to or different from each other; $R^{10}$ represents a halogen atom, an alkyl group having a carbon number of 1 to 6, or a substituted or non-substituted aromatic hydrocarbon group having a carbon number of 6 to 12, and the multiple $R^{10}$'s may be identical to or different from each other; $X^4$ and $X^5$ are each $(CH_2)_h$, and the multiple $X^4$'s and $X^5$'s may be identical to or different from each other, respectively; (h) is an integer from 1 to 6; (u) is an integer from 0 through 4, and the multiple (u)'s may be identical to or different from each other; (v) is an integer from 1 to 150; and (w) is an integer from 1 to 50.

20. The organic photoreceptor unit according to claim 19, wherein the thickness of said second charge transport layer is 3 to 15 μm, and the combined thickness of said first charge transport layer and said second charge transport layer is 18 to 35 μm.

21. The organic photoreceptor unit according to claim 19, wherein said first bonding resin comprises at least one resin that is selected from a group consisting of styrene resin, acrylic resin, styrene-acrylic resin, bisphenol A polycarbonate resin and bisphenol Z polycarbonate resin.

22. The organic photoreceptor unit according to claim 19, wherein said first charge transport layer and said second charge transport layer each contain silicone oil.

23. The organic photoreceptor unit according to claim 19, wherein the product (M×T) of the content M of said fluorine resin particles relative to 100 parts by weight of said second bonding resin and the thickness T of said second charge transport layer is 200 to 1,500.

24. The organic photoreceptor unit according to claim 19, wherein said polycarbonate resin is a polycarbonate resin expressed by a general formula (I-1):

(I-1)

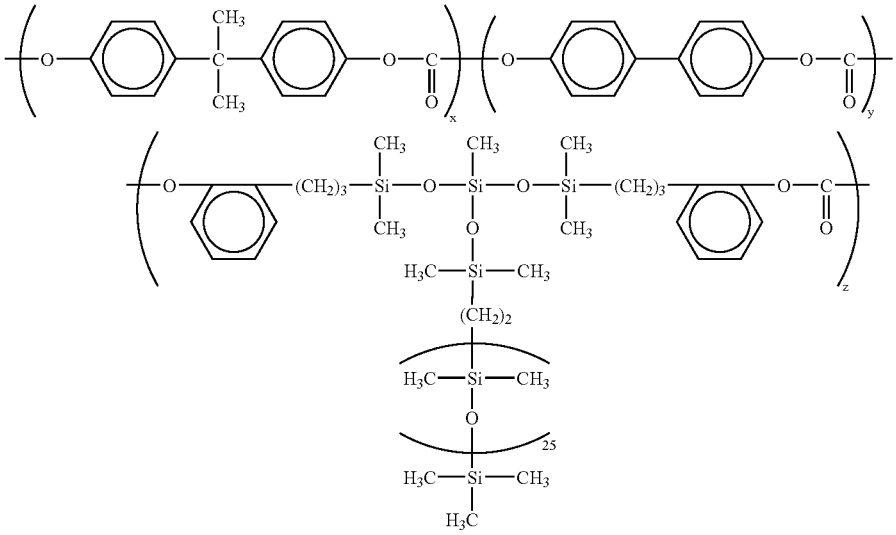

wherein the ratio x/(x+y+z) is 0.5 to 0.95, and the ratio z/(x+y+z) is 0.0001 to 0.1.

25. The organic photoreceptor unit according to claim 19, wherein said polycarbonate resin is a polycarbonate resin having recurring units expressed by a general formula (II-1):

(II-1)

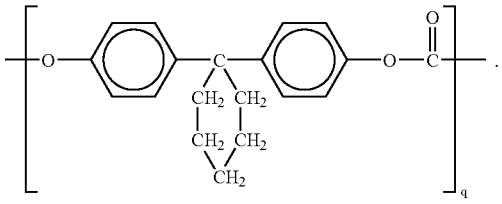

26. The organic photoreceptor unit according to claim 19, further comprising a sub-layer on said conductive base unit wherein said charge generating layer is formed on said sub-layer.

27. The organic photoreceptor unit according to claim 19, wherein said polycarbonate resin is a polycarbonate resin having recurring units expressed by the general formula (I).

28. The organic photoreceptor unit according to claim 19, wherein said polycarbonate resin is a polycarbonate resin having recurring units expressed by the general formula (II).

29. The organic photoreceptor unit according to claim 19, wherein said polycarbonate resin is a polycarbonate resin having recurring units expressed by the general formula (III).

30. The organic photoreceptor unit according to claim 19, wherein said polycarbonate resin is a polycarbonate resin having recurring units expressed by the general formula (IV).

* * * * *